US006305634B1

(12) United States Patent
Rodriguez

(10) Patent No.: US 6,305,634 B1
(45) Date of Patent: Oct. 23, 2001

(54) TRACK AND FLAP ASSEMBLY FOR CUTTING TAPE

(75) Inventor: Peter A. Rodriguez, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 09/421,702

(22) Filed: Oct. 20, 1999

(51) Int. Cl.[7] ..... B65H 35/08

(52) U.S. Cl. ..... 242/526.2; 83/542; 83/553

(58) Field of Search ..... 242/526.2, 419, 242/419.4; 83/56, 553, 542

(56) References Cited

U.S. PATENT DOCUMENTS 5,046,675 * 9/1991 Rodriguez ..... 242/526.2

* cited by examiner

*Primary Examiner*—John Q. Nguyen
(74) *Attorney, Agent, or Firm*—Arthur G. Yeager

(57) ABSTRACT

A track and flap assembly employs an elongate compressible foam member completely covering an elongate channel that carries a paper cutting tape. Between the bottom of the foam member and the top of the channel are one or two pivotally mounted resilient flap members that cooperate with the foam member to provide a desired frictional drag and exiting resistance to control the cutting tape movement during turn up. A compressed air passage is provided to allow for forced air removal of debris and other contaminants from the tape channel. The assembly is constructed in two configurations to accommodate different papermaking apparatus.

21 Claims, 5 Drawing Sheets

TRACK AND FLAP ASSEMBLY FOR CUTTING TAPE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates to track assemblies for cutting tape used in turn up operations in the papermaking industry and particularly to an enclosed track assembly used to minimize contamination of the cutting tape.

2. Related Art

A wide variety of protected track assemblies are known to the art. For example, applicant's U.S. Pat. No. 5,467,937 discloses a movable flap for covering the cutting tape and the guideway that it rests within. Improvements are necessary, however, to provide for greater protection of the tape. In addition, improvements are needed in cutting tape tension control. The devices known to the art are deficient in that they do not provide both features with the same assembly.

BRIEF SUMMARY OF THE INVENTION

In one aspect of the present invention there is provided a track assembly for guiding a cutting tape transversely across a moving web of paper being wound on a roll and transferring the cut web to an empty roll. The assembly includes a track and a track support, the track being an elongated member having an upper portion and a lower portion and a first mounting means for supporting the track on the track support and a longitudinal channel formed in the upper portion for containing a length of a cutting tape therein. The channel is covered by a compressible means along the channel adapted to be compressed to uncover the channel when a cutting tape is exiting the channel. A second mounting means is rigidly affixed to the track for securing the compressible means to the track, the compressible means providing a controlled resistance against a cutting tape exiting to assist in control of a tape spooling on an empty roll. compressible means is formed of a foam material and includes an upper surface and a lower surface, the lower surface extending transversely across the channel.

In other aspects of the invention there is provided a first elongate flap member mounted between the lower surface of the compressible means and the upper portion of the member and extending transversely across the channel and being substantially the length of the track. The first flap member is movable upwardly when a cutting tape is withdrawn from the channel to compress said compressible means, the first flap member has an upper surface and a lower surface, the lower surface of the first flap member frictionally engaging a cutting tape when the tape is being withdrawn from the channel. Securing means for securing the first flap member to the track. A second elongate flap member has an upper surface and a lower surface mounted between the lower surface of the first flap member and the upper surface of the member, the lower surface of the second flap member upwardly movable and frictionally engaging a cutting tape when the tape is exiting the channel.

The track has a proximal end near an operator and a distal end across the width of the web of paper, the compressible means including a first portion adjacent said distal end of the track and a second portion extending from the first portion to the proximal end, the first portion of the compressible means having a relative compressibility different from the relative compressibility of the second portion of said compressible means to provide for two different controlled resistances for controlling the exiting of the cutting tape from the channel. There is also compressed air means for blowing air into the channel when a cutting tape is exiting the channel to keep the channel free of contaminants from the surrounding environment. The track is an elongated member having an upper portion and a lower portion and a first longitudinal channel formed in the lower portion for supporting the track on the track support and a second longitudinal channel formed in the upper portion for containing a length of a cutting tape therein. The second channel being covered by an elongated compressible means adapted to be compressed to uncover the second channel when a cutting tape is exiting the second channel. A thin elongated film member having an upper surface and a lower surface is mounted to the lower surface of the first flap member, the lower surface of the film member upwardly movable and frictionally engaging a cutting tape when the tape is exiting the second channel. The flap members include an inner edge portion and an outer edge portion adjacent the roll and securing means are provided for pivotally mounting a flap member at the inner edge portion to said track. The compressible means and flap member are removably mounted to the track.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

INTRODUCTION

Figure 1:
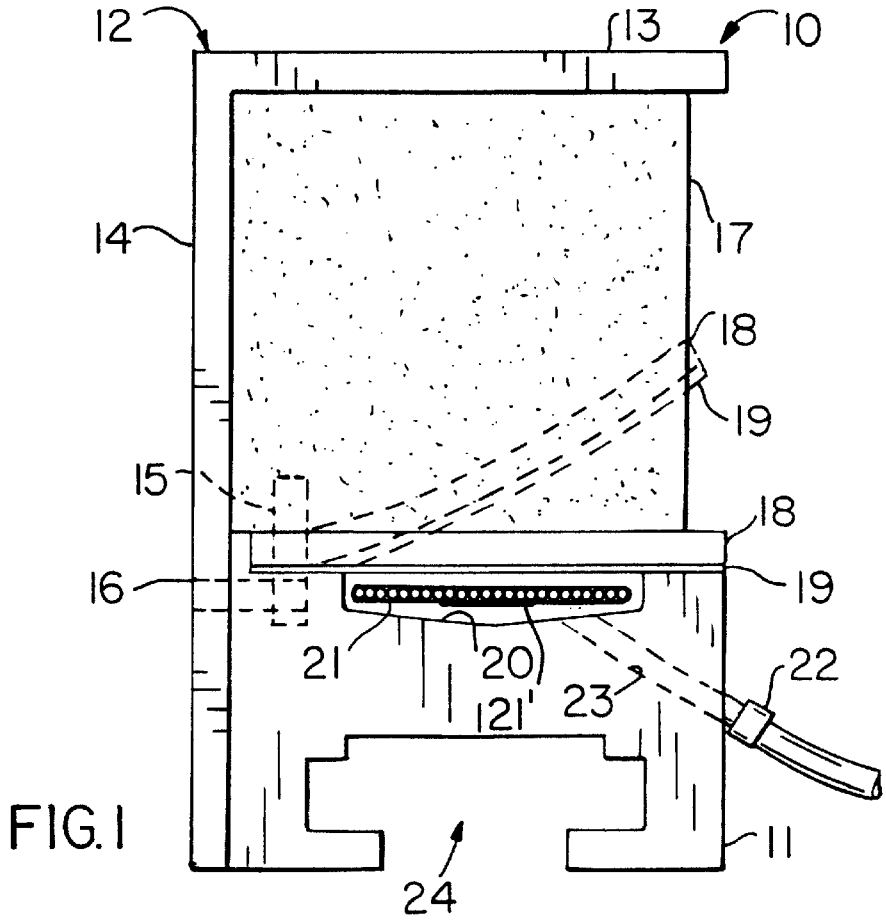
FIG. 1 is an end elevation of the improved track and flap assembly in accord with the present invention.

As understood in the art, a length of paper tape is used in the paper industry to cut a moving web of paper being wound up on a roll and to transfer the cut edge of the paper to an empty wind up roll without having to stop the paper movement. The web of paper moves under a lead-in roller and over a drive roller to a wind up roll. A drive roll is driven by an outside source, and it drives a wind up roll by frictional contact. When the wind up roll becomes large enough it is necessary to cut the paper web and start it winding on a new roll. In this case, an empty wind up roll is lowered vertically until it contacts the drive roll.

In order to cut the moving paper web and start it winding onto the empty roll a cutting tape is moved forward and is caught in the nip of the rolls. The tape is wrapped helically around the roll and in so doing it cuts through the paper web and leads the cut edge onto the empty roll which continues to wind up the web until it is full and the entire operation is repeated to cut and transfer the web to a new, empty wind up roll. Soon after the web is transferred to the roll, the full roll is moved away from the drive roll and an empty roll is moved down to the previous position of the full roll.

The tape that is introduced into a track may be directed to a dispensing section where it is treated to apply a coating of pressure-sensitive adhesive to the forward section of the tape. The tape is then cut to a finite length and pushed along until the tip is at the terminal of a end guideway. The tape is then stopped and held in position until an operator decides it is time to cut and transfer the web to a new roll. Neither a dispensing station nor the adhesive-applying station is a necessary part of the present invention.

The track assembly used abuts the end of the track from a dispensing section and continues across the web from a proximal end to a distal end. The track continues from the distal end through an upward curing and twisting section to a terminal end. The adhesive coating, if applied in the dispensing section, is preferably on the bottom of tape as it crosses through the track assembly and must be twisted to be on top when it is fed to roll so as to stick to the roll and carry along with it the cut edge of the paper web.

The present invention relates to the track and carrier from the proximal end to the terminal end.

The systems used often include a brake in the form of a clamping device to apply a variable resistance to the tape for preventing or inhibiting its movement through the track assembly. Movement is stopped when the tape is first moved into position with its forward tip at the terminal end. When the time for cutting the web of paper occurs, the tip of the tape is fed into the nip and the tape is suddenly accelerated to a high speed by its contact with the roll which causes the tape to be jerked out of the track assembly. At this time the brake is applied to provide resistance but not prevent movement of the tape. As soon as the tip starts to wind around the roll, the brake resistance causes the tape to become taut and cut the web as it is moved across the web because of being wound helically on the roll. The tape will be pulled rapidly and upwardly out of track and brake must be applied properly for this to happen with control and without breakage of the tape. A sensor may also be employed to be sure there is no tape in the track after the cutting operation is finished. If the tape breaks, there may be some pieces of tape in the track that will impede the next setup.

The system described herein is applicable in other industries besides papermaking that use the turn up methodology disclosed.

CONSTRUCTION

With regard now to FIG. 1, the improved track and flap assembly is illustrated at numeral 10. The assembly 10 includes a frame 11 for mounting to the papermaking machinery. A housing portion 12 includes a top wall 13 and a side wall 14 and is rigidly connected to frame member 11 by adhesive or other appropriate means as understood in the art.

An elongate foam block member 17 is mounted between walls 13 and 14 via fasteners 15 and 16. Foam member 17 is compressible. A flap member 18 is secured via fasteners 15 and 16 and is mounted under foam member 17. Flap member 18 is used to provide a smooth low friction surface for contact with tape band 21 when the tape is withdrawn from the elongate channel 20. Depending upon the variables in a particular application such as paper type and machine speed it may be possible to provide a foam member 17 that has a lower surface with the desired friction coefficient and accordingly flap 18 could be eliminated.

A second flap 19 is illustrated to be either a distinct member located between flap 18 and channel 20. In most cases flap 19 would actually be a thin film of low friction material attached by adhesive to the lower surface of flap 18.

Channel 20 is a tape band guideway and is formed in frame member 11 to accommodate the tape band 21 that is to be used in a given application. It is to be understood that tape band 21 may include a strip of adhesive 21' and the V-notched base of channel 20 provides space below adhesive strip 21' to prevent it from sticking to the channel 20. T-shaped channel 24 is used to mount the assembly 10 to the frame of the associated papermaking apparatus.

Air hose 22 directs air via passageway 23 into guideway channel 20 to prevent contamination from entering the channel 20 during tape withdrawal. Such contamination could adversely affect the withdrawal of a tape band 21 during the turn up cycle.

During the withdrawal of tape 21 foam block 17 is compressed as flaps 18 and 19 are forced against it due to the tension on the tape 21. The amount of movement will depend on the specific application including factors such as the speed and angle of tape 21 exit as well as the type of material used for block 17 and the flaps 18 and 19 (if used in the circumstances).

Figure 2:
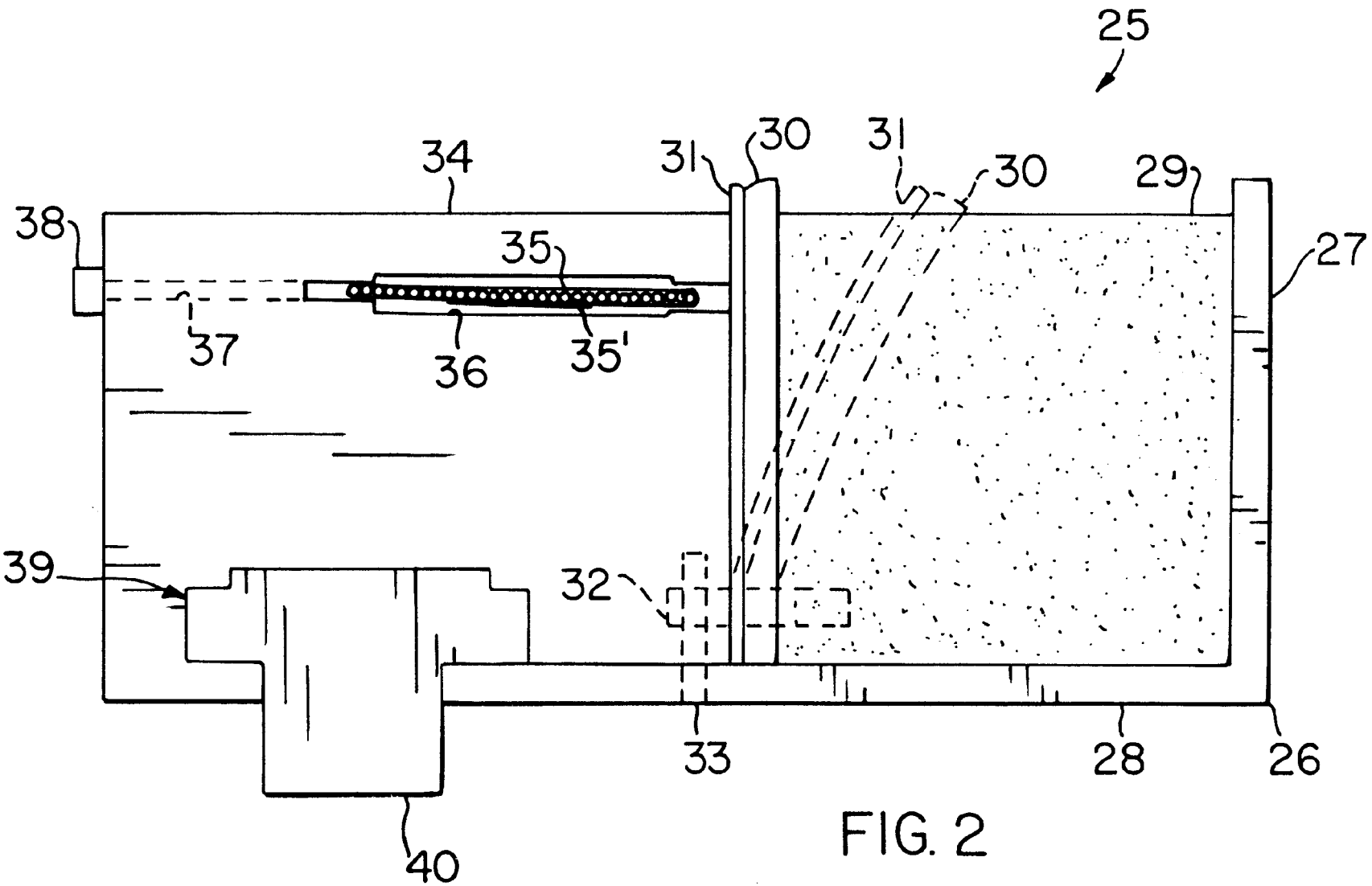
FIG. 2 is an end elevation of an alternate embodiment of the present invention.

In FIG. 2 an alternative embodiment of the improved track and flap assembly is illustrated at numeral 25. Housing 26 includes side wall 27 and bottom wall 28 rigidly connected to frame 34. Foam block 29, first flap 30 and second flap 31 may be identical to their counterparts in FIG. 1 or may be of different materials as desired in the circumstances. Fasteners 32 and 33 provide attachment means for elements 29, 30 and 31.

Channel or passageway 36 is formed in frame 34 and supports tape band 35 including adhesive layer 35'. Air hose connection 38 provides a means for directing pressurized air into passageway 37 and to passageway 36 to prevent contamination from entering the passageway during the withdrawal of tape band 35. T-shaped space 39 provides for the mounting of frame 34 to a frame support 40.

Assembly 25 employs a different layout than that of assembly 10. The choice of assembly 10 or 25 is controlled largely be the available space to mount the apparatus to a specific papermaking apparatus and maintain adequate clearance to minimize interference with the machines.

In both assemblies 10 and 25 the housings 12 and 26 are rigidly mounted to respective frames 11 and 34 to prevent any movement between them. This feature allows for control of the tension of the corresponding tape band 21 and 35 to be controlled during withdrawal by way of the selection of the materials for the foam blocks 17 and 29 and the use of additional flaps 18, 19 and 30, 31 if desired. Movement of either frame 11 or 34 combined with compression of block 17 or 29 would greatly complicate the control of the withdrawal of a respective tape band 21 or 34 during turn up.

ASSEMBLY OPERATION

Flaps 18 and 19 (FIG. 1) and 30 and 31 (FIG. 2) are pivotally mounted via respective fasteners 15, 16 and 32, 33. Flaps 18 and 30 are preferably made of urethane or ultrahigh molecular weight (UHMW) polyethylene material to provide the desired stiffness and coefficient of friction to control tape withdrawal. If needed, an additional flap element 19 and 31 may be added or bonded to respective flaps 18 and 30 if the flaps 18 and 30 have the desired stiffness but not the desired friction surface.

Frames 11 and 26 are also preferably made of UHMW polyethylene to minimize friction against tape band 21 or 35 yet to also have sufficient rigidity for proper tape withdrawal. Foam blocks 17 and 29 are made of a material chosen for the specific application and function as springs to provide a braking action on respective tape band 21 or 35 during tape withdrawal. The braking action assists in maintaining proper tension of a tape band to provide for fast turn up. In addition, proper tension of a tape band assists in straightening curved band material if it is supplied to a user in a wound spool as is often the case.

Figure 3:
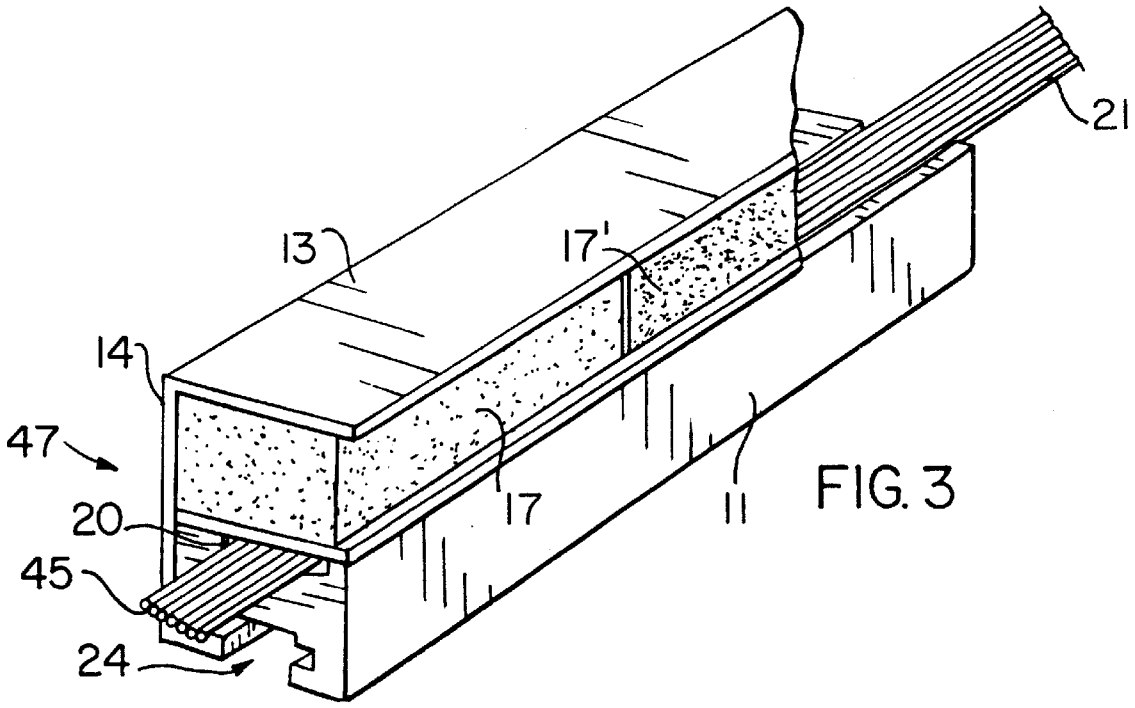
FIG. 3 is a perspective view of a portion of a track assembly according to the present invention.
Figure 4:
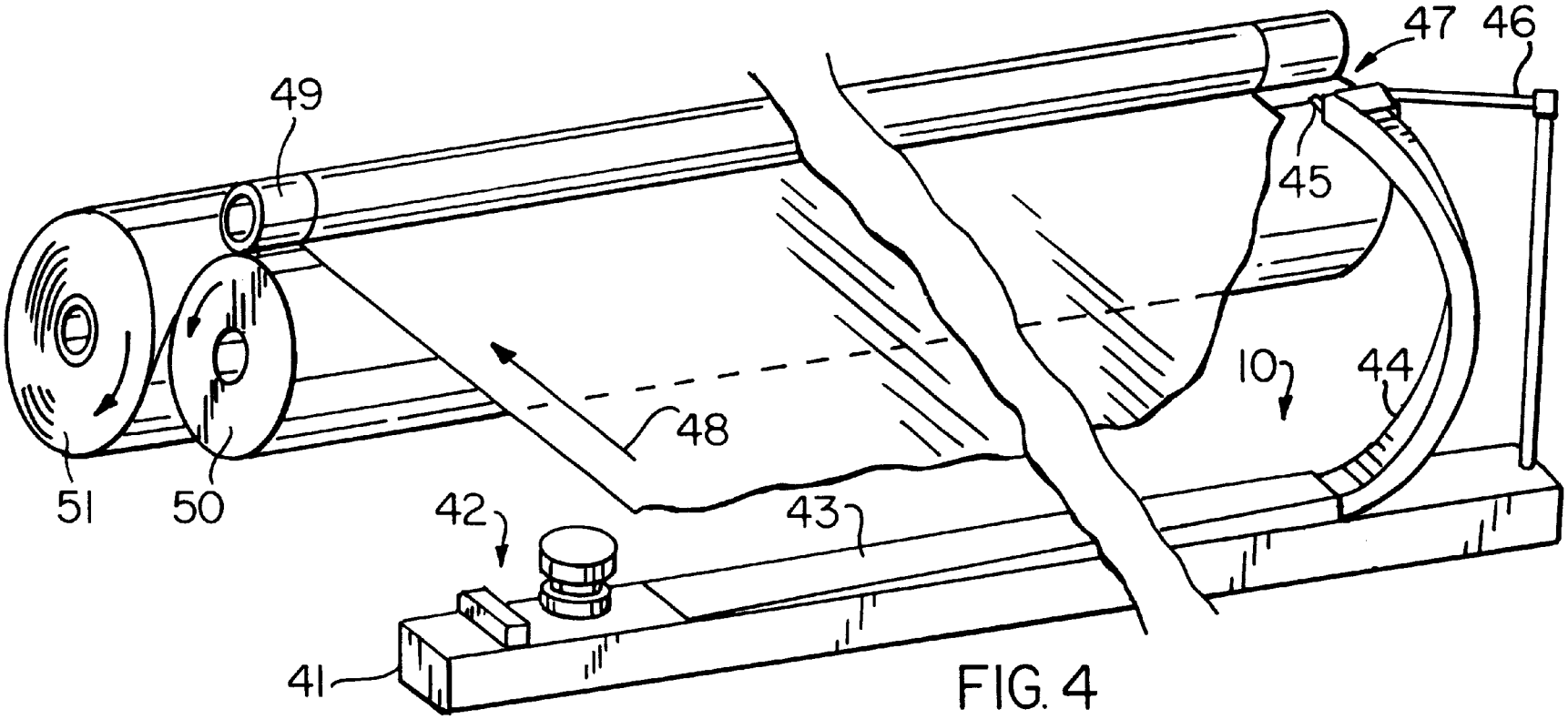
FIG. 4 is a perspective view of the assembly of FIG. 1 showing its relationship to papermaking machinery.

Two perspective views of the assembly 10 are provided in FIGS. 3 and 4. FIG. 3 illustrates the leading end 45 of tape band 21 extending slightly beyond the distal end 47 of the track assembly in FIG. 3 an alternative embodiment of foam block 17 is shown illustrating two types of foam 17, 17' that have different densities and therefore different compressibility against tape band 21 during withdrawal. This feature provides for less braking of the tape band 21 against low density block 17 as tape withdrawal begins and more braking of the tape 21 as it is withdrawn against block 17' which extends all the way to the entry or proximal end 41 of the track assembly 10. Foam material having lengthwise variable density can also be used if desired in the circumstances.

In FIG. 4 an overall view of an assembly 10 is shown in relation to the web moving in direction 48. Tape loading apparatus 42 (shown only generally) feeds a length of tape band into a first substantially straight track section 43 and from there into a vertical and curved track section 44. Distal end 47 of the track assembly 10 is supported by frame 46. Empty roll 49, roller 50, and full roll 51 are all standard. Frame support 40 fits into space 24 (FIG. 1) or 39 (FIG. 2) and is shown only generally. Sections 43 and 44 are preferably fabricated separately for ease in manufacturing.

Figure 5:
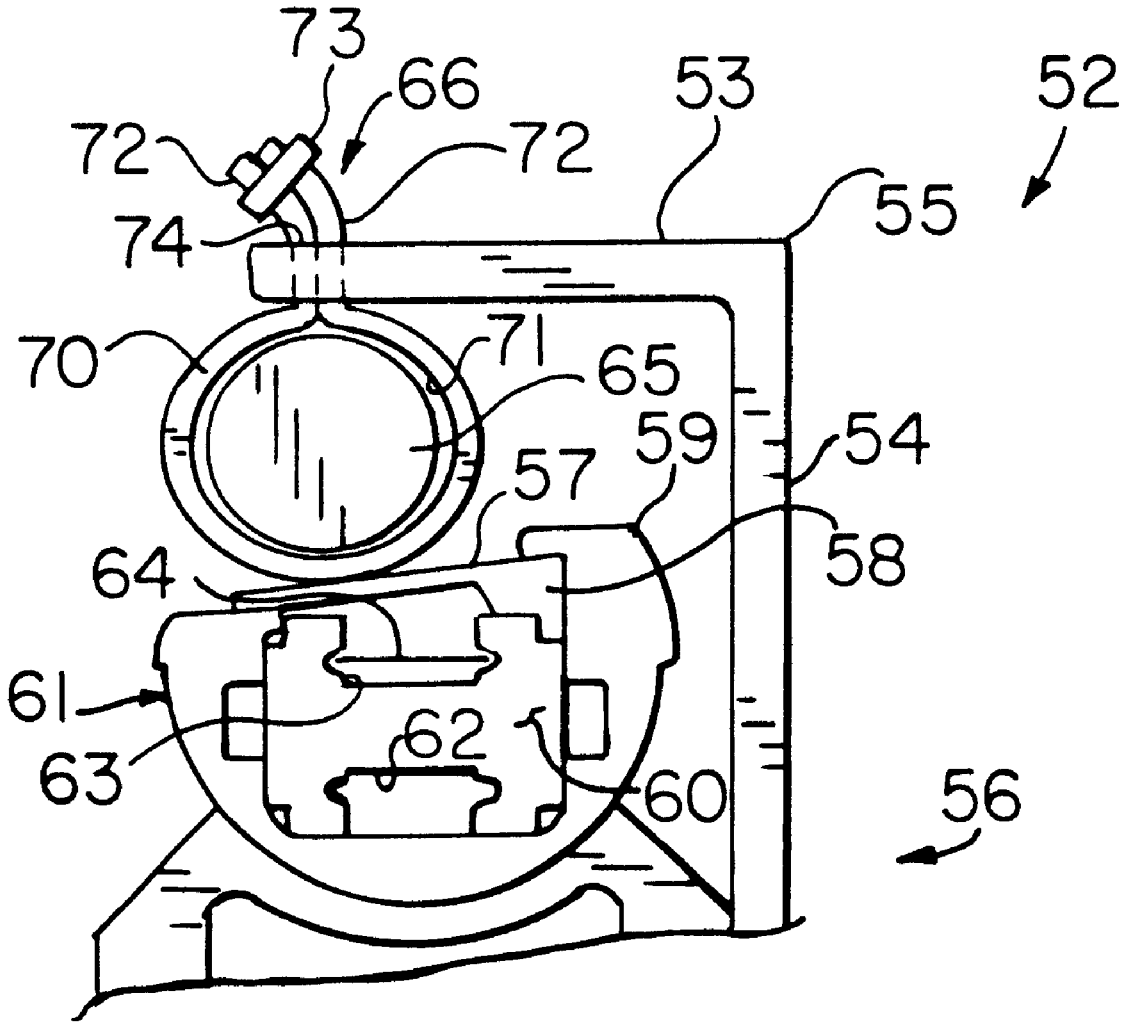
FIG. 5 is a pictorial cross-sectional view of an alternative track and flap assembly adjacent one end thereof.

With reference now to FIG. 5, an alternative embodiment of a track and flap assembly is shown at numeral 52. Top wall 53 and side wall 54 form housing 55 which is mounted to the frame 56 of the papermaking apparatus and is shown only generally.

Flap 57 is hinge mounted by fitting flap base portion 58 between inside portion 59 of housing 61 and track body 60 carried therein. Track body 60 includes a lower channel 62 and an upper channel 63 shown carrying tape 64. Channel 62 is identical to channel 63 and can be used when channel 63 wears our or becomes damaged by inverting body 60. Housing 61, track body 60 and flap base 58 can be held in place by any appropriate means such as adhesive.

An air-filled longitudinal tube 65 shown expanded is used to apply downward force on flap 57. Tube 65 is flexible to allow for compression when tape 64 is withdrawn from channel 63 during a turn up operation. The means to secure tube 65 against lateral movement is shown generally at 66. A plastic loop clamp 70 is secured around tube 65 loosely as indicated by space 71. The two ends 72 of clamp 70 are pulled through space 74 in top wall 53 are secured via securing tie 73. Clamp 70 is narrow enough longitudinally speaking to not interfere with the downward force tube 65 maintains on flap 57. The number of means 66 used depends on the specific application and variables such as the length of tube 65.

Assembly 52 will generally extend the entire width of the web of paper and into the upwardly curved portion of the track (as shown in FIG. 4).

Figure 6:
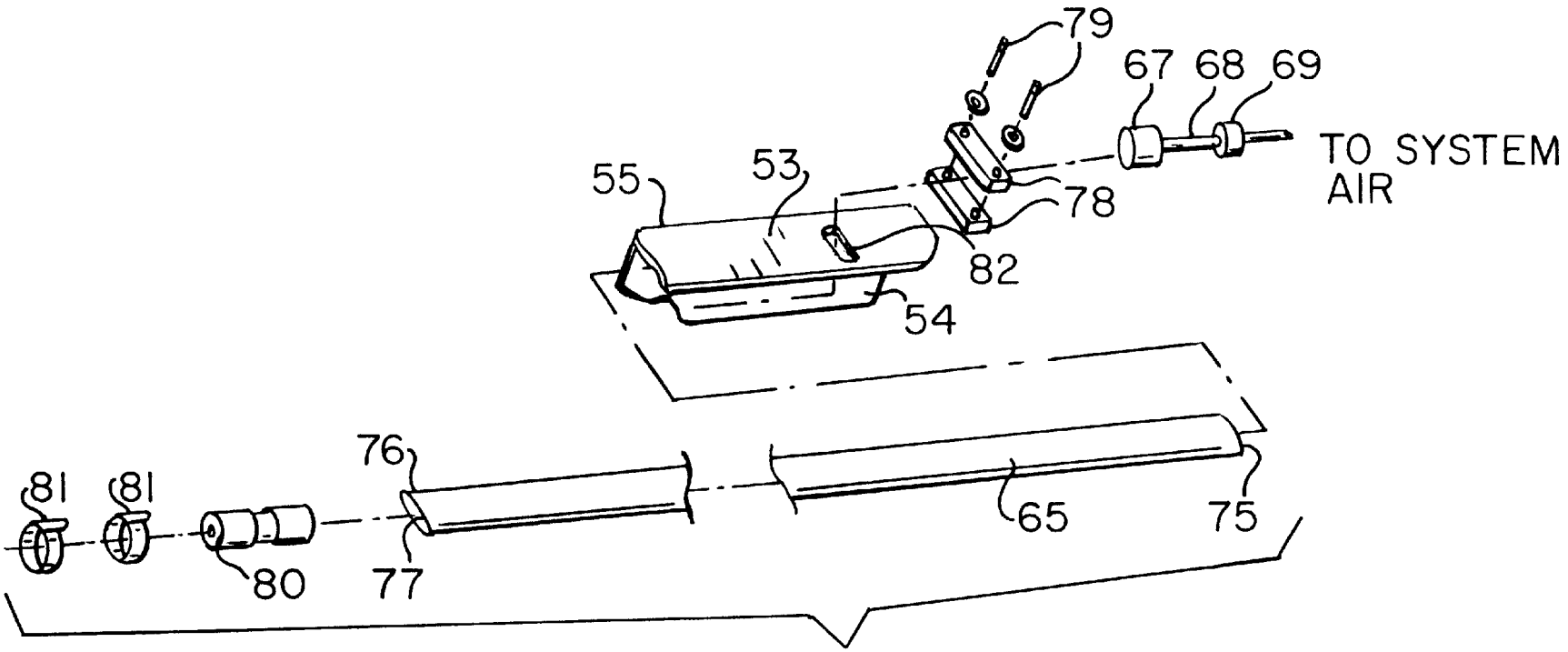
FIG. 6 is a schematic pictorial diagram of the tube of FIG. 5 and associated air supply and securing apparatus.

With regard to FIG. 6, a pictorial view of a length of tube 65 is shown as it may be mounted adjacent. Tube 65 is generally flat when not inflated and is cut to the desired length for a particular application. One end 76 of tube 65 is closed by inserting plug 80 into opening 77. Adhesive, such as silicone, is placed on the exterior of plug 80 before it is inserted into opening 77. Two standard hose clamps 81 are used to secure plug 80 in place.

The other end 75 of tube 65 is attached to the system air apparatus as illustrated in FIG. 5. Once the tube 65 is pressurized to the desired pressure the end 75 is closed by squeezing it between two clamp members 78 that are pulled together via screws and washers 79 after end 75 is pulled upwardly through opening 82.

Air supply fitting 67, air hose 68 and control valve 69 are the means by which the tube 65 is inflated are standard items as understood in the art and are shown only generally. The air pressure apparatus is preferably removable from the tube after the desired pressure in tube 65 is attained. Air is the preferred way of pressurizing tube 65 but water might also be used in appropriate circumstances.

While the invention has been described with respect to certain specific embodiments, it will be appreciated that many modifications and changes may be made by those skilled in the art. It is intended, therefore, by the appended claims to cover all such modifications and changes as fall within the true spirit and scope of the invention.

What is claimed as new and what it is desired to secure by Letters Patent of the United States is:

1. A track assembly for guiding a cutting tape transversely across a moving web of paper being wound on a roll and transferring the cut web to an empty roll, said assembly including a track and a track support, said track being an elongated member having an upper portion and a lower portion and a first mounting means for supporting said track on said track support and a longitudinal channel formed in said upper portion for containing a length of a cutting tape therein, said channel being covered by a compressible means along said channel adapted to be compressed to uncover said channel when a cutting tape is exiting said channel, second mounting means for securing said compressible means to said track, said compressible means providing a controlled resistance against a cutting tape exiting said channel to assist in control of a tape spooling on an empty roll.

2. The track assembly as defined in claim 1 wherein said compressible means is formed of a foam material.

3. The track assembly as defined in claim 1 wherein said compressible means includes an upper surface and a lower surface, said lower surface of said compressible means extending transversally across said channel.

4. The track assembly as defined in claim 3 further including a first elongate flap member mounted between said lower surface of said compressible means and said upper portion of said elongated member and extending transversely across said channel and being substantially the length of said track, said first flap member being movable upwardly when a cutting tape is withdrawn from said channel to compress said compressible means, said first flap member having an upper surface and a lower surface, said lower surface of said first flap member frictionally engaging a cutting tape when cutting tape is being withdrawn from said channel.

5. The track assembly as defined in claim 4 further including securing means for securing said first flap member to said track.

6. The track assembly as defined in claim 4 further including a second elongate flap member having an upper surface and a lower surface mounted between said lower surface of said first flap member and said upper portion of said elongated member, said lower surface of said second flap member upwardly movable and frictionally engaging a cutting tape when the tape is exiting said channel.

7. The track assembly as defined in claim 3 wherein said track has a proximal end near an operator and a distal end across the width of the web of paper, said compressible means including a first portion adjacent said distal end of said track and a second portion extending from said first portion to said proximal end, said first portion of said compressible means having a relative compressibility different from the relative compressibility of said second portion of said compressible means to provide for two different controlled resistances for controlling the exiting of the cutting tape from said channel.

8. The track assembly as defined in claim 1 wherein said compressible means is elongated and extends substantially the length of said channel.

9. The track assembly as defined in claim 1 further including compressed air means for blowing air into said channel when a cutting tape is exiting said channel to keep said channel free of contaminants from the surrounding environment.

10. A track assembly for guiding a cutting tape transversely across a moving web of paper being wound on a roll and transferring the cut web to an empty roll, said assembly including a track and a track support, said track being an elongated member having an upper portion and a lower portion and a first longitudinal channel formed in said lower portion for supporting said track on said track support and a second longitudinal channel formed in said upper portion for containing a length of a cutting tape therein, said second channel being covered by an elongated compressible means adapted to be compressed to uncover said second channel when a cutting tape is exiting said second channel, mounting means for securing said compressible means to said track, said compressible means providing a controlled resistance against a cutting tape exiting to assist in control of a tape spooling on an empty roll.

11. The track assembly as defined in claim 10 wherein said compressible means is formed of a foam material includes an upper surface and a lower surface, said lower surface extending transversely across said second channel.

12. The track assembly as defined in claim 11 further including an elongated flap member mounted between said lower surface of said compressible means and said upper portion of said elongated member and extending transversely across said second channel and being substantially the length of said track, said first flap member being movable upwardly against said compressible means when a cutting tape is withdrawn from said channel to compress said compressible means, said first flap member having an upper surface and a lower surface, said lower surface of said first flap member frictionally engaging a cutting tape when the tape is being withdrawn from said second channel.

13. The track assembly as defined in claim 12 further including securing means for pivotally mounting said flap member to said track.

14. The track assembly as defined in claim 12 further including a thin elongated film member having an upper surface and a lower surface mounted to said lower surface of said flap member, said lower surface of said film member upwardly movable and frictionally engaging a cutting tape when the tape is exiting said second channel.

15. The track assembly as defined in claim 11 wherein said compressible means has a proximal end near an operator and a distal end across the width of the web of and adjacent to paper, said compressible means including a first portion adjacent said distal end and a second portion extending from said first portion to said proximal end, said first portion of said compressible means having a density different from the density of said second portion of said compressible means to provide for two different controlled resistances for controlling the exiting of the cutting tape from said second channel.

16. The track assembly as defined in claim 10 wherein said compressible means extends substantially the length of said second channel.

17. A track assembly for guiding a cutting tape transversely across a moving web of paper being wound on a roll and transferring the cut web to an empty roll, said assembly including a track and a track support, said track being an elongated member having an upper portion and a lower portion and a first mounting means for supporting said track on said track support and a longitudinal channel formed in said upper portion for containing a length of a cutting tape therein, said channel being covered by a compressible means along said channel adapted to be compressed to uncover said channel when a cutting tape is exiting said channel, second mounting means for securing said compressible means to said track, said compressible means providing a controlled resistance against a cutting tape exiting to assist in control of a tape spooling on an empty roll, said compressible means including an upper surface and a lower surface, said lower surface of said compressible means said upper portion of said elongated member extending transversely across said channel, and an elongated flap member mounted between said lower surface of said compressible means and said upper portion of said elongated member and extending transversely across said channel and being substantially the length of said track, said flap member being movable upwardly when a cutting tape is withdrawn from said channel to compress said compressible means, said flap member having an upper surface and a lower surface, said lower surface of said flap member frictionally engaging a cutting tape when the tape is being withdrawn from said channel.

18. The track assembly as defined in claim 17 further including a thin film member secured to the lower surface of said flap member for frictionally engaging a cutting tape exiting said channel.

19. The track assembly as defined in claim 17 wherein said flap member includes an inner edge portion and an outer edge portion adjacent the roll, securing means for pivotally mounting said flap member at said inner edge portion to said track.

20. The track assembly as defined in claim 17 wherein said compressible means and said flap member are removably mounted to said track.

21. The track assembly as defined in claim 17 wherein said compressible means includes an inflatable elongate tube having opposite end portions, one said end portion having an inlet for receiving a pressurizing fluid thereby inflating said tube, another said end portion being selectively closable to maintain inflation of said tube, and means to selectively pressurize said tube to a desired pressure.

* * * * *